US005295651A

United States Patent [19]

Baker, Jr.

[11] Patent Number: 5,295,651

[45] Date of Patent: Mar. 22, 1994

[54] KLEAR KLIP

[75] Inventor: Gary E. Baker, Jr., 4517 Terry La., Wilmington, N.C. 28405

[73] Assignee: Gary E. Baker, Jr., Wilmington, N.C.

[21] Appl. No.: 947,848

[22] Filed: Sep. 21, 1992

[51] Int. Cl.[5] ..... A47G 1/00

[52] U.S. Cl. ..... 248/488; 248/544

[58] Field of Search ..... 248/488, 489, 475.1, 248/544

[56] References Cited

U.S. PATENT DOCUMENTS

| | | | |
|---|---|---|---|
| 2,142,321 | 1/1939 | Maley | 248/488 |
| 3,188,028 | 6/1965 | Waller | 248/489 |
| 3,349,443 | 10/1967 | Sury | 248/490 X |
| 3,680,822 | 8/1972 | Kurtz | 248/475.1 |
| 4,238,103 | 12/1980 | Kurtz | 248/488 X |
| 4,340,199 | 7/1982 | Brock | 248/490 X |
| 4,394,000 | 7/1983 | Kurtz | 248/488 X |
| 4,473,207 | 9/1984 | Nascher | 248/490 |
| 4,509,278 | 4/1985 | Astolfi | 248/490 X |

FOREIGN PATENT DOCUMENTS

| | | | |
|---|---|---|---|
| 583546 | 1/1925 | France | 248/490 |
| 282101 | 1/1929 | United Kingdom | 248/488 |

*Primary Examiner*—Karen J. Chotkowski

[57] ABSTRACT

The "klear klip" is a unique one piece design clear plastic mirror clip with no exposed screws. It has a slanted ramp in the base of the clip to strengthen the bottom of the clip to serve as a device to hold the mirror snug to prevent the mirror from rattling and to maximize the ventilation on the back of the mirror to prevent mirror deterioration. The top clip has a screw depth gauge which automatically stops the mounting screw at the proper position which allows the clip to open and close freely. The elongated design allows the installer to measure for the top clip mounting screw position without having to subtract any fractions of an inch. This helps prevent the top clip from being mounted at the wrong height. When the mirror is mounted on a flat surface the top clip may also used as a bottom clip to minimize the space between the mirror and the surface that it is mounted on. When a larger space is required or when the mirror is to be mounted a certain distance above a solid surface, the heavy duty bottom clip is required. Unlike metal clips, when the "klear klip" is mounted, its crystal clear body design is virtually unseen against the surface of the mirror and it will not rust or corrode.

2 Claims, 2 Drawing Sheets

KLEAR KLIP

SUMMARY OF THE INVENTION

Of the different kinds of mirror clips on the market today there are only two basic styles of clips that may be classified as a one piece clear plastic and they are the rosette and the clamp styles (ref. Sommer and Maca catalog). Both of these types were simply designed to mount a mirror inexpensively. The rosette and the clamp styles both have exposed screws. The screws are highly visible and in time will rust or corrode. The rosette and clamp styles both hold the mirror tight against the wall. This does not allow for proper ventilation to the back of the mirror and in time will promote mirror deterioration.

Unlike the rosette and clamp style clips, the "klear klip" was designed to incorporate a variety of innovative features.

1. A one piece construction—this design will provide the most economical form for mass production. The low cost of the plastic injection process will allow the clip to be made in the United States and still be competitive with any imports.
2. Low visability—when someone views a mirror, they look to see a reflection, not the method of mirror attachment. Clear plastic is the best choice and is virtually unseen against the surface of the mirror.
3. Concealed mounting screws—this method is best for low visibility. Exposed screws are quickly seen and in time they rust and corrode.
4. A slanted ramp—this feature prevents the mirror from shaking and rattling after the mirror is hung. The ramp also strengthens the base of the clip and gives adequate ventilation to prevent mirror deterioration.
5. A screw depth gauge—the top clip is able to slide freely from the open to close position with the aid of the screw depth gauge. The proper resistance is created by pressure from the mounting screw against the depth gauge. Other clips with a similar quick release feature operates from a two piece construction with the aid of resistance springs or an elastic plastic mechanism. The "klear klip" is able to accomplish this same function without any extra parts. The screw depth gauge also serves the purpose of holding the top clip in the open position before the mirror is installed as a convenience to the installer.
6. Extra long top clip to eliminate fraction measurements—with a few quick measurements the installer can mark the location for the mounting screws before punching any holes. When determining the location for the mounting screw for the top clip the installer must measure from the base of the bottom clip up the height of the mirror and subtract one inch. All other top clips on the market has to measure up the height of the mirror and subtract a fraction of an inch. If the installer makes a subtraction error, he mounts the clips in the wrong place.

DESCRIPTION OF THE EMBODIMENT

Figure 1:
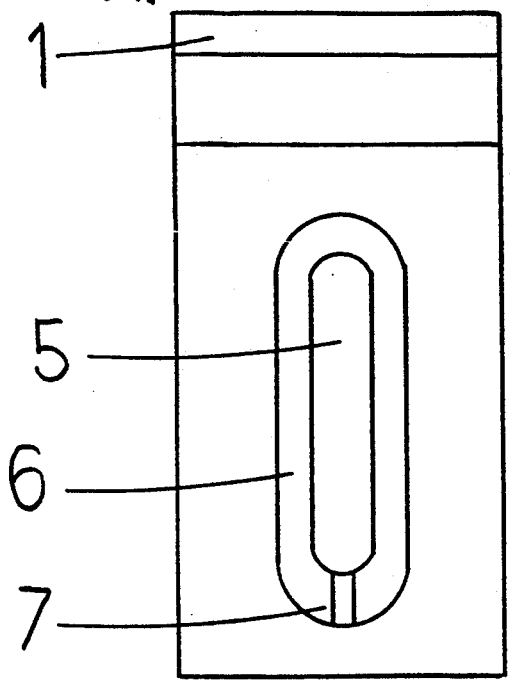
FIG. 1 is the front view of the top clip.
Figure 2:
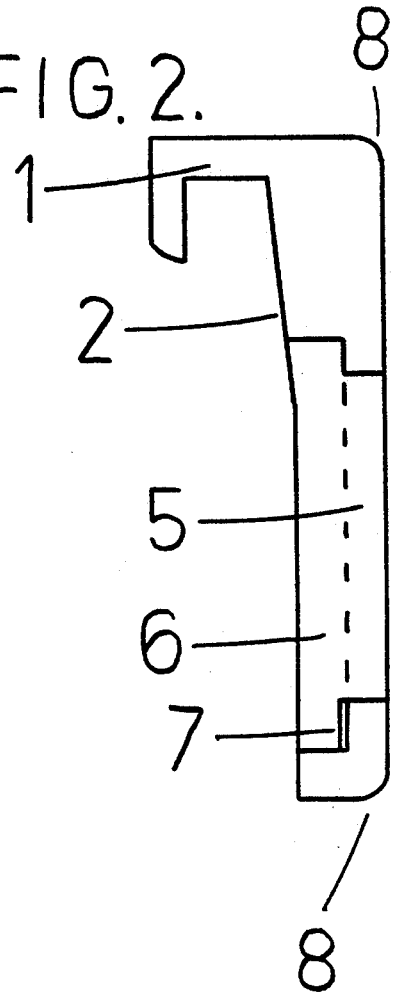
FIG. 2 is the profile view of the top clip (FIG. 1).
Figure 3:
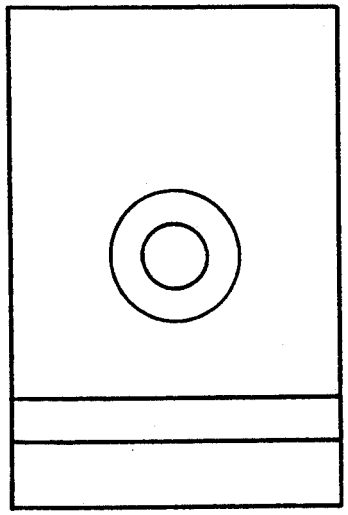
FIG. 3 is the front view of the bottom clip.
Figure 4:
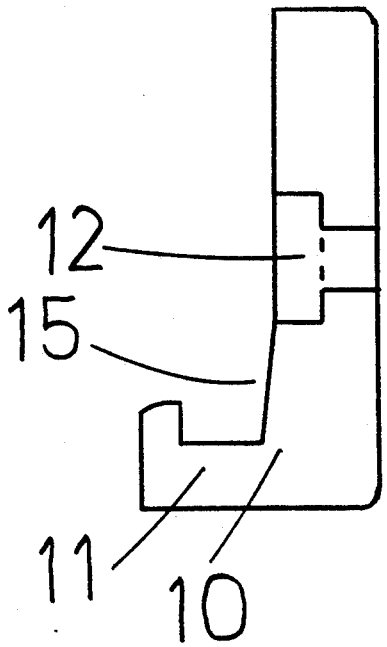
FIG. 4 is the profile view of the bottom clip (FIG. 3).
Figure 5:
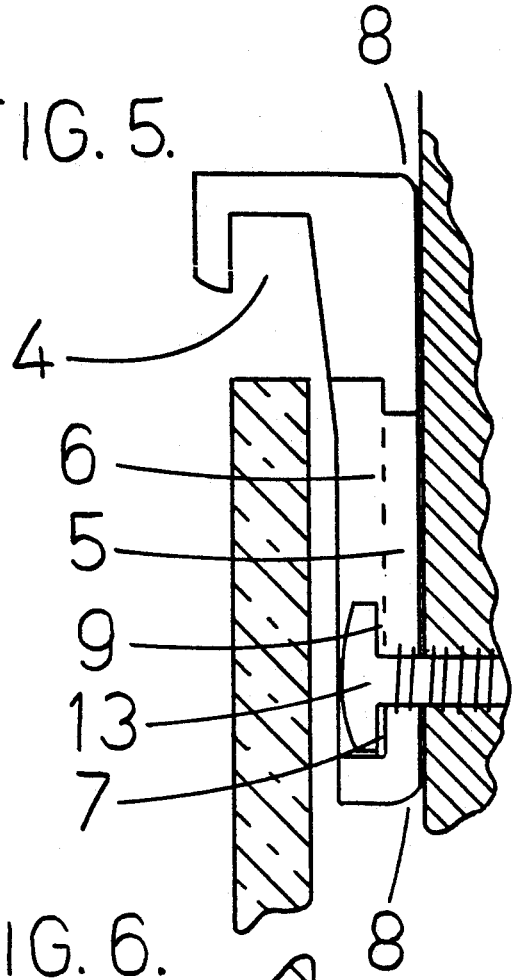
FIG. 5 is the profile view of the top clip mounted to a wall in the open position.
Figure 6:
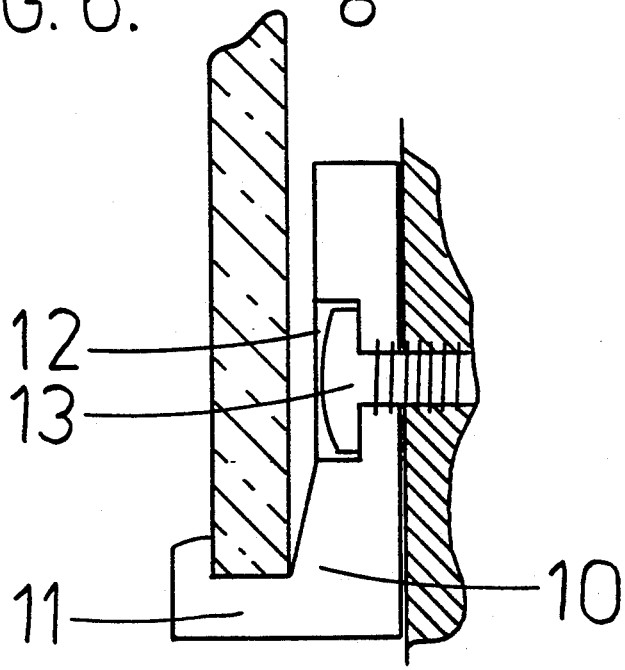
FIG. 6 is the profile view of the bottom clip mounted to a wall with a mirror in the mounted position.
Figure 7:
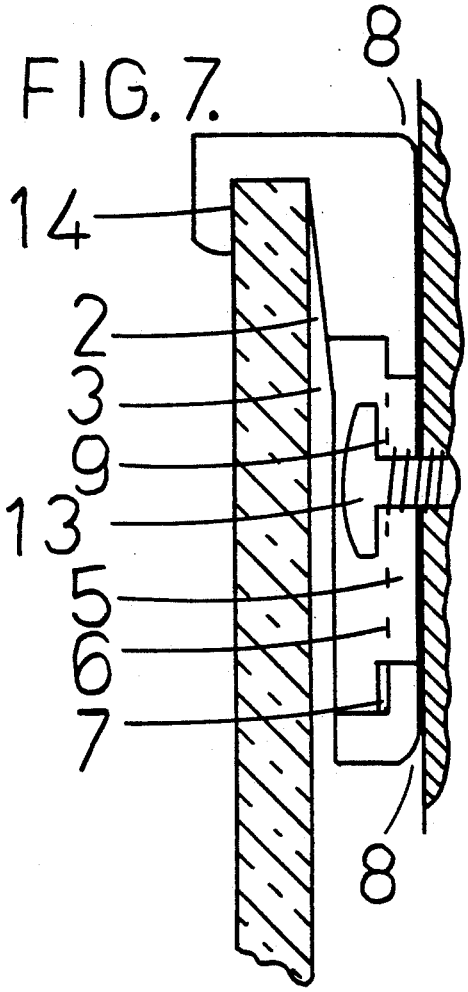
FIG. 7 is the profile of the top clip in the closed position securing the mirror.

The top clip (FIG. 1, 2, 5 and 7) is unique in its design. It has a one piece body made of crystal clear, high strength plastic. The top of the clip (FIG. 1-1, 2-1) is thin for low visibility. The slanted ramp 2 (FIG. 2—2, 7-2) is designed to provide a convenient wide opening (FIG. 5-4) for the mirror to enter as it is being mounted. The ramp then forces the mirror forward to hold it tight to prevent rattling (FIG. 7-14). The ramp also creates an air space 3 for ventilation to prevent mirror deterioration (FIG. 7-3). The top clip has an elongated screw slot 5 (FIG. 1-5, 7-5). The mounting screw 13 passes through (FIG. 1-5, 5—5) and the screw head catches on the recessed lip (FIG. 1-6, 5-6) to support the clip and to recess the screw head. The top clip has a screw depth gauge (FIG. 5-7) that prevents the mounting screw 13 from being over tightened by the installer. When the screw is snug against the depth gauge 7, two things happen. First, the top clip is held in the open position for the installers convenience (FIG. 5) and second, the screw is at the proper depth which will allow the clip to be tight against the wall but still be loose enough to operate up and down freely (FIG. 7-9). The top clip has smooth back corners to prevent binding during opening and closing (FIG. 2-8, 7-8).

The bottom clip (FIG. 3, 4, and 6) is made of the same material as the top clip. The bottom clip also has a slanted ramp (FIG. 4-15) which gives an extra benefit, additional strength by reinforcing the area where the mirror weight rests (FIG. 6-10). The bottom portion of the bottom clip is also thicker for additional strength (FIG. 4-11, 6-11). The clip has a single round screw hole 12 with a countersink to recess the mounting screw head (FIG. 4-12, 6-12).

The embodiments of the invention in which an exclusive property or privilege is claimed are defined as follows:

1. A plastic mirror mounting clip comprising, a back plate having an integral flange on one edge extending forwardly from the front side of the back plate and an integral lip on the flange spaced forwardly from the forward side of the back plate, a mounting screw having a pan head, phillips head and a threaded shank, the back plate having an elongated, flat, recessed screw slot extending perpendicular to the flange for receiving the shank and the head of the mounting screw, the elongated, flat, recessed screw slot having a raised lip to serve as a screw depth gauge for the head of the mounting screw, the back plate having a solid ramp slanting from the back plate forward intersecting the integral flange.

2. A plastic mirror mounting clip according to claim 1 wherein the clip has a one piece clear plastic body design having no exposed screws, metal parts and minimal exposed plastic parts when installed.

* * * * *